United States Patent [19]

Irvine

[11] Patent Number: 5,060,945

[45] Date of Patent: Oct. 29, 1991

[54] GAME WITH MOVABLE PLAYERS

[76] Inventor: John Irvine, 624 East Coast Road, Browns Bay, Auckland, New Zealand

[21] Appl. No.: 535,759

[22] Filed: Jun. 11, 1990

[30] Foreign Application Priority Data

Jun. 9, 1989 [NZ] New Zealand ..... 229476

[51] Int. Cl.[5] ..... A63F 7/06

[52] U.S. Cl. ..... 273/85 B

[58] Field of Search ..... 273/85 R, 85 A, 85 B, 273/85 E, 85 F, 94

[56] References Cited

U.S. PATENT DOCUMENTS

| | | | |
|---|---|---|---|
| 593,512 | 11/1897 | Cahalane | 273/94 R |
| 2,229,232 | 1/1941 | Widegren et al. | 273/85 B |
| 4,076,242 | 2/1978 | Joseph | 273/85 B |
| 4,311,309 | 1/1982 | Bradley et al. | 273/85 B |

FOREIGN PATENT DOCUMENTS

| | | |
|---|---|---|
| 0710673 | 6/1954 | United Kingdom . |
| 0800015 | 8/1958 | United Kingdom . |
| 1147711 | 4/1969 | United Kingdom . |
| 2006626 | 5/1979 | United Kingdom . |
| 2148723 | 6/1985 | United Kingdom . |

*Primary Examiner*—William H. Grieb

*Attorney, Agent, or Firm*—St. Onge Steward Johnston & Reens

[57] ABSTRACT

A game, to be played by two operators, one at each end thereof, simulates a game such as soccer, hockey, ice hockey or the like. A central playing area has a flat surface (11) above which substantially nothing protrudes apart from the players and a simulated ball or the like. The players can be moved towards and away from the operator on members (24) and also can be rotated, as required by means of gears 29 engaged with racks (30, 31) or the like.

16 Claims, 1 Drawing Sheet

GAME WITH MOVABLE PLAYERS

This invention relates to a game and is applicable particularly, but not exclusively to a game simulating a field game in which two opposing teams of players propel an object, such as a ball around a playing field. Typical of such full-size games are soccer, hockey, ice-hockey or the like, but the game of the present invention is not limited to simulating such above-mentioned field games.

Games which simulate a game of soccer are known, in which players representing miniature versions of the two opposing teams are mounted on parallel rods located above a playing surface representing a soccer field. The rods are reciprocable along their length and rotatable about their axes, alternate rods being operable from one end of the game and the intermediate rods being operable from the opposite end of the game. Such prior art games suffer from being unrealistic, since the operating mechanism is above the surface of the simulated playing field. They are also inflexible.

Hereinafter the term "operator" is used for the person who plays the game according to the invention and the term "player" is used for the miniature model of the person playing the game being simulated.

According to one aspect of the present invention, there is provided a game including a playing area, one or more players adapted to be movable above the surface of the playing area by an operator, so as to propel an object on the playing area, and operating means operable by the operator to move the or each player, in which substantially no part of the operating means protrudes above the surface of the playing area where there is no player.

Preferably the operating means is adapted optionally to move the player in one direction of translation and to rotate the player about an axis, which may be normal to said direction of translation.

For simulation of some games, the game according to the invention conveniently includes said operating means for one player or one set of players operable from one end of the game and operating means for another player or another set of said players operable from an opposite end of the game.

Advantageously, the operating means includes a member on which the player is mounted, the member being positioned entirely beneath said surface of the playing area and constrained to slide in said one direction of translation only. The member may be a bar extending in the one direction and adapted to receive and hold a plurality of said players.

Conveniently, the rotation of the player is effected by a toothed rack engaged with a toothed gear connected to rotate the player, the rack being movable parallel to said member. There may be two racks for each of said members, one rack engaging with the gears of one or more players mounted on said member nearer the operator and the other of said racks engaging with the gears of one or more players mounted on said member further from the operator.

Preferably the or each player is mounted on a pin affixedly insertable into a co-axial bore of said gear.

One embodiment of the invention is described, by way of example only, with reference to the accompanying drawings in which.

Figure 1:
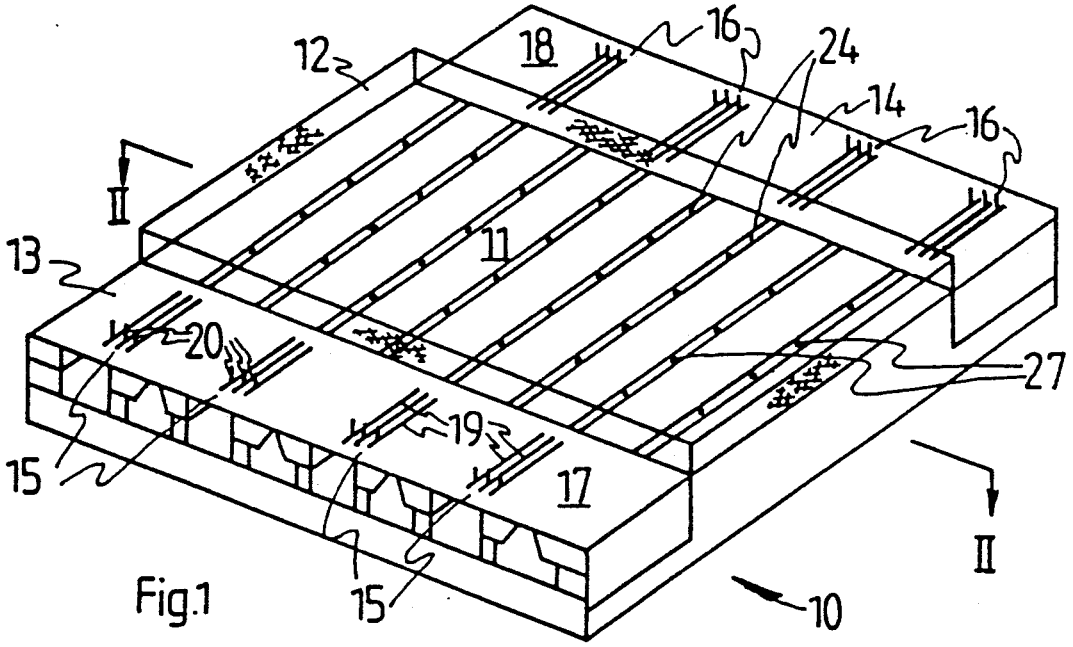
FIG. 1 is a perspective view of a game according to the invention.

In the drawings, a game includes a board, indicated generally at 10, having a central rectangular flat playing surface 11, preferably bounded by a fence 12, which may be of mesh or other suitable materials. At either end of the board 10 is a control area 13, 14, each of which has four equally spaced control positions 15, 16. The positions 16 are staggered relative to the position 15.

The control areas 13, 14 have covers 17, 18 of sheet material and at each control positions 15, 16 the covers 17, 18 have three parallel slots 19 through each of which a control pin 20 protrudes upwardly.

Figure 2:
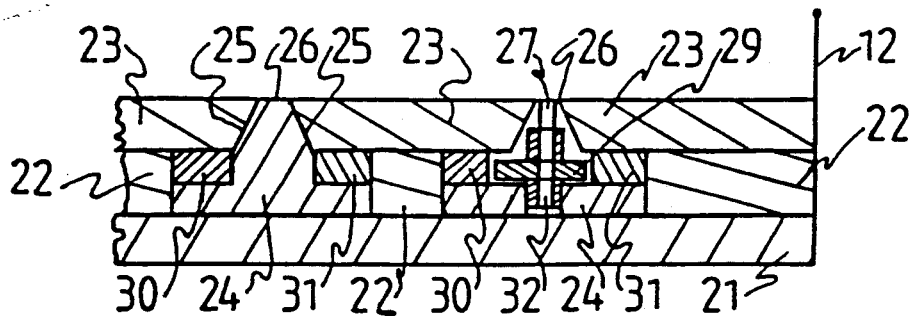
FIG. 2 is a part section along the line II—II in FIG. 1, at enlarged scale.

As shown in FIG. 2, the board 10 comprises a base board 21 to which parallel spacer bars 22 are affixed and on the upper surface of which parallel slats 23 are fastened. The upper surfaces of the slats 23 are co-planar and form the playing surface 11.

Between each adjacent pair of spacer bars 22, there is a bar 24, of inverted T section. Each bar 24 is constrained to slide in the direction of its length only, by the base board 12, the spacer bars 22, and inclined surfaces 25 on the edges of the slats 23. The upper surfaces 26 of the bars 24 are as narrow as practical and co-planar with the playing surface 11.

As seen in FIGS. 1 and 2, each bar 24 has a plurality of spaced central holes 27, through each of which a peg 28 (seen in FIGS. 4 and 5) can freely pass.

At each hole 27 the bar 24 carries a toothed gear 29, the teeth of the gear 29 protruding beyond the sides of the upright limb of the bar 24. Spigots on the gear 29 are rotatable in vertical bores in the bar 24. For convenience of assembly, each bar 24 may be composed of three separate elements stuck, screwed or otherwise affixed together.

Figure 3:
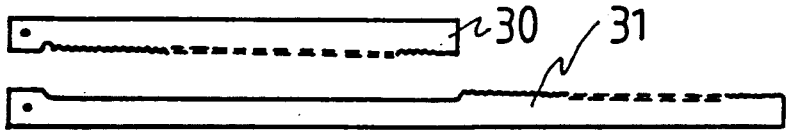
FIG. 3 is a plan of two components used in the game shown in FIG. 1.

Between the spacer bars 22 and on either side of the upright limb of the bar 24, there is slidably located a short toothed rack 30 and a long toothed rack 31, shown in FIG. 3.

The teeth on the racks 30, 31 engage the teeth on any of the gears 29 which are alongside the rack 30 or 31, but not both racks simultaneously. The control pins 20 at any one control positions 15, 16, are fastened respectively into the rack 30, the bar 24 and the rack 31.

Instead of the gears 29 and racks 30, 31 being toothed, drive from one to the other could be by friction, for which purpose each gear 29 could be provided with an elastomeric tire.

Alternatively, pulleys and cord could be used instead of the gears 29 and racks 30, 31 respectively, or even sprockets in place of the gears 29 engaged by fine chains in place of the racks 30, 31.

Figure 4:
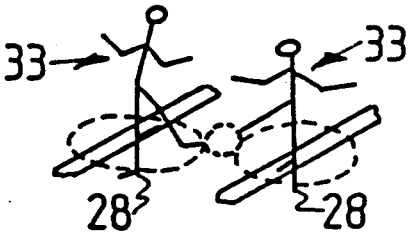
FIGS. 4 and 5 show players used in the game, in diagrammatic form.
Figure 5:
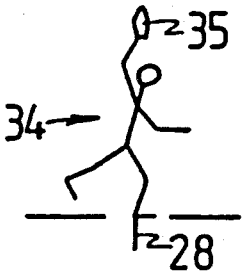

Although each peg 28 is a loose fit in the hole 27 in the bar 24, the peg 28 is a push fit into a co-axial bore 32 in each gear 29. Each peg 28 has firmly affixed thereabove a player 33, 34 as shown in FIGS. 4 and 5. If the game being simulated is soccer, each player 33 has one leg extended away from the other leg, which "stands" on the peg 28. Thus, if a ball is adjacent a player 33, it can be kicked by the player 33, either by the operator sliding the bar 24 to which the particular player 33 is attached by the peg 28, or by rotating the player 33 about the axis of the peg 28 by sliding whichever of the racks 30, 31 is engaged with the gear 29 of the particular player 33. By skillful manipulation of the control pin 20, a combined translatory and rotary movement of the player 33 can be achieved. The players 33 can be distributed over the playing surface 33, as two teams, by pushing the peg of each player 33 into a chosen one of the bores 32. Spacing between adjacent bars 24 is chosen in relation to the spread of the legs of adjacent players 33, so as to minimise "dead" space on the playing surface 11, as shown in FIG. 4. The players 33 are shown in diagrammatic form, since they can be modelled with any chosen degree of realism and colouring to suit different teams and different simulated games.

Where hockey, ice hockey or the like are being simulated, the players 33 carry a protruding stick, for use instead of their protruding leg. In such games, goals can be mounted or stood on the playing surface 11. The ball used may have some feature which reduces the tendency to excessive rolling, such as one or more flats on the surface thereof.

FIG. 5 shows a player 34 adapted for throwing a ball, as in cricket or the like. In this case, one hand has a cup formation 35, in which the ball can be placed and projected by pushing the bar 24 forwards and then stopping it abruptly. This movement is assisted by the provision of a flexible joint of rubber or the like in the leg which is attached to the peg 28.

Clearly, the game can be adapted for simulating a variety of different games. For this purpose, the playing surface 11 can be marked out with easily removable marking, to simulate a soccer field, a hockey pitch, a cricket pitch etc. The players 33, 34 can be formed and dressed appropriately. Similarly, for some games, such as "crazy" golf, various obstacles can be positioned on the playing surface 11, as required and the player 33 provided with a golf club.

In order that the control pins 20 can reach the racks 30, 31, the inclined surfaces 25 of the slats 23 may be cut back locally, as can be seen in FIG. 1.

The players 33, 34 can be more realistic if their arms and/or their legs are attached to the bodies thereof by frictional pivots, such as ball-and-socket joints, whereby the arms or legs can be moved and set at a variety of dispositions. Such an articulated construction facilitates moulding of the bodies, arms or legs by enabling parting lines of moulding dies therefor to be on or close to a single plane.

I claim:

1. A game including a playing area, one or more players adapted to be movable above the surface of the playing area by an operator, so as to propel an object on the playing area, and operating means operable by the operator to move the or each player, in which substantially no part of the operating means protrudes above the surface of the playing area where there is no player, in which the operating means includes a member on which the player is mounted, the member being positioned entirely beneath said surface of the playing area and constrained to slide in said one direction of translation only, and in which the member is a bar extending in the said one direction and adapted to receive and hold a plurality of said players.

2. A game as in claim 1, in which the operating means is adapted optionally to move the player in one direction of translation and to rotate the player about an axis, substantially normal to said direction of translation.

3. A game, as in claim 2, in which the rotation of the player is effected by a toothed rack engaged with a toothed gear connected to rotate the player, the rack being movable parallel to said member.

4. A game, as in claim 3 in which the or each player is mounted on a pin affixedly insertable into a co-axial bore of said gear.

5. A game, as in claim 3, including two racks for each of said members, one rack engaging with the gears of one or more players mounted on said member nearer the operator and the other of said racks engaging with the gears of one or more players mounted on said member further from the operator.

6. A game, as in claim 2, in which the or each player is rotatable by a wheel engaged therewith, the or each wheel being in frictional engagement with an optionally movable elongate body.

7. A game, as in claim 1, in which at least one limb of the player is pivoted to the body thereof by a pivot having sufficient friction to enable the limb to be moved and set at a variety of dispositions.

8. A game, as in claim 1, in which the member is provided with a plurality of locations along the length thereof, at each of which locations the or one of the players may be optionally located.

9. A game including a playing area, one or more players adapted to be movable above the surface of the playing area by an operator, so as to propel an object on the playing area, operating means operable by the operator to move the or each player, in which substantially no part of the operating means protrudes above the surface of the playing area where there is no player, in which the operating means is adapted optionally to move the player in one direction of linear translation, and to rotate the player about an axis, substantially normal to said direction of linear translation, the operating means including a member on which the player is mounted, the member being positioned entirely beneath said surface of the playing area and constrained to slide in said one direction of translation only, and in which an upper surface of said member is shaped and located to form a substantially continuous surface coplanar with the surface of the playing area.

10. A game, as in claim 9, in which the rotation of the player is effected by a toothed rack engaged with a toothed gear connected to rotate the player, the rack being movable parallel to said member.

11. A game, as in claim 10, including two racks for each of said members, one rack engaging with the gears of one or more players mounted on said member nearer the operator and the other of said racks engaging with the gears of one or more players mounted on said member further from the operator.

12. A game, as in claim 11, in which the or each player is rotatable by a wheel engaged therewith, the or each wheel being in frictional engagement with an optionally movable elongate body.

13. A game, as in claim 12, in which the or each player is mounted on a pin affixedly insertable into a co-axial bore of said gear.

14. A game, as in claim 9, in which at least one limb of the player is pivoted to the body thereof by a pivot having sufficient friction to enable the limb to be moved and set at a variety of dispositions.

15. A game, as in claim 9, in which the member is provided with a plurality of locations along the length thereof, at each of which locations the or one of the players may be optionally located.

16. A game, as in claim 9, in which the operating means at all working positions thereof, is contained within the plan area of a board on which the playing area is formed.

* * * * *